United States Patent [19]

Patik

[11] Patent Number: 5,011,135

[45] Date of Patent: Apr. 30, 1991

[54] THERAPEUTIC HAND EXERCISER

[76] Inventor: Robert M. Patik, 823 Reservoir St., Mt. Pleasant, Pa. 15666

[21] Appl. No.: 377,258

[22] Filed: Jul. 10, 1989

Related U.S. Application Data

[63] Continuation-in-part of Ser. No. 199,862, May 25, 1988, abandoned.

[51] Int. Cl.[5] ..... A63B 23/16

[52] U.S. Cl. ..... 272/67

[58] Field of Search ..... 272/67, 135, 141, 68; 128/26; 84/465, 467

[56] References Cited

U.S. PATENT DOCUMENTS

| | | | |
|---|---|---|---|
| 3,612,521 | 10/1971 | Wendeborn | 272/67 |
| 4,730,827 | 3/1988 | Williams | 272/68 |
| 4,828,249 | 5/1989 | Keating | 272/68 |
| 4,840,370 | 6/1989 | Biddlecombe | 272/68 |

FOREIGN PATENT DOCUMENTS

| | | | |
|---|---|---|---|
| 0848319 | 8/1970 | Canada | 272/67 |
| 2126110 | 3/1984 | United Kingdom | 128/26 |
| 206592 | 12/1986 | United Kingdom | 272/67 |

*Primary Examiner*—Randall L. Green
*Assistant Examiner*—David H. Willse
*Attorney, Agent, or Firm*—Lawrence R. Burns

[57] ABSTRACT

A therapeutic hand exerciser is disclosed which is made of a pliable composition such as polyester and which has holes installed in one or both sides for the insertion of fingers from either side. When the fingers are inserted into the holes and snugly encompassed thereby, the pliable composition allows each finger to maneuver in any direction in a 360 degree manner while providing a therapeutic resistance. The fingers on one hand can be used simultaneously or independently on one side of the exerciser to assist the fingers of the other hand on the other side of the exerciser, if desired, when operating the device in the same direction or opposing directions. This exerciser can also provide therapeutic resistance for the arms, chest, shoulders, and upper body in general.

6 Claims, 2 Drawing Sheets

THERAPEUTIC HAND EXERCISER

RELATED APPLICATIONS

This application is a continuation-in-part of application Ser. No. 199,862, filed May 25, 1988, now abandoned.

BACKGROUND OF THE INVENTION

This invention relates to a therapeutic hand exerciser for example people suffering from muscle deterioration or weakness in the fingers and hands.

Many people are in need of finger and hand therapy. The elderly are especially in need of an affordable and effective therapeutic hand exerciser for strengthening their fingers in preparation for daily chores in their own home.

When this exerciser is made of a light density composition, children at a very early age can exercise their hands, arms, chest, shoulders, and upper body in general, and when made of a heavy density composition, those going to gymnasiums can use this exerciser.

Various types of therapeutic hand exercisers are on the market but, so far as I am aware, none of them has the range of therapeutic performance of the device of this simplified invention.

Some inventions are in need of professional instruction due to the seriousness of the isolated conditions they are to treat, in which case, their material composition and structure have that purpose for treatment.

This invention, due to its material composition, structure, and with the insertion of the fingers in the holes in a snugly encompassed manner, permits a person to make a tightly closed fist in one instant, and then expand the hand to its full extention in another instant, while turning, pulling, twisting or pushing the embodiment.

SUMMARY OF THE INvENTION

In view of the forgoing, an object of this invention is to provide an inexpensive and effective therapeutic hand exerciser.

Accordingly, the invention provides a therapeutic hand exerciser comprising a body of pliable material provided with a plurality of finger holes for the insertion of one or more fingers in a snugly encompassed manner of one hand, so as to permit movement of inserted fingers in various directions to achieve a therapeutic exercise effect.

The exerciser is made of a pliable composition, such as polyester, or similar composition, thus affording a therapeutic resistance in a 360 degree manner for each finger. The fingers on one hand can be used simultaneously or independently on one side of the exerciser to assist the fingers of the other hand on the other side of the exerciser, if desired, when operating the device in the same direction or opposing directions by pulling, pushing, turning, or twisting the embodiment.

The shape of this device can vary from being planar, circular, spherical or other shaped embodiment and the holes for the insertion of the fingers can be angular, through, or partially through the exerciser body and located in any desired configuration, effectively accommodating various hand sizes and conditions. One embodiment of the invention allows for the insertion of the fingers of one hand in one side of the exerciser and the insertion of the fingers of the other hand in the other side of the exerciser, simultaneously or separately thus permitting both hands to exercise at the same time, in the same manner, and on the same exerciser.

BRIEF DESCRIPTION OF THE DRAWINGS

Embodiments of the invention will now be described, by way of example, with reference to the accompanying drawings, in which:

Referring now to the drawings, FIG. 1 shows a hand exerciser 10 provided with a pluralitY of holes 11, 12, 13, 14, and 15, located in a desired configuration to permit insertion of fingers and thumb of one hand. As seen in FIG. 2 the holes can be through holes 16, blind holes 17, 18, extending from the front or rear face of the device, or angled holes 19, 20, which could extend partly or wholly through the exerciser 10. Any desired combination of holes can be employed chosen from the indicated type. Hand exerciser 10, as seen in FIG. 3, depicts the exerciser 10 with fingers inserted, showing the exerciser 10 in its approximate position with the fingers when in use.

Figure 1:
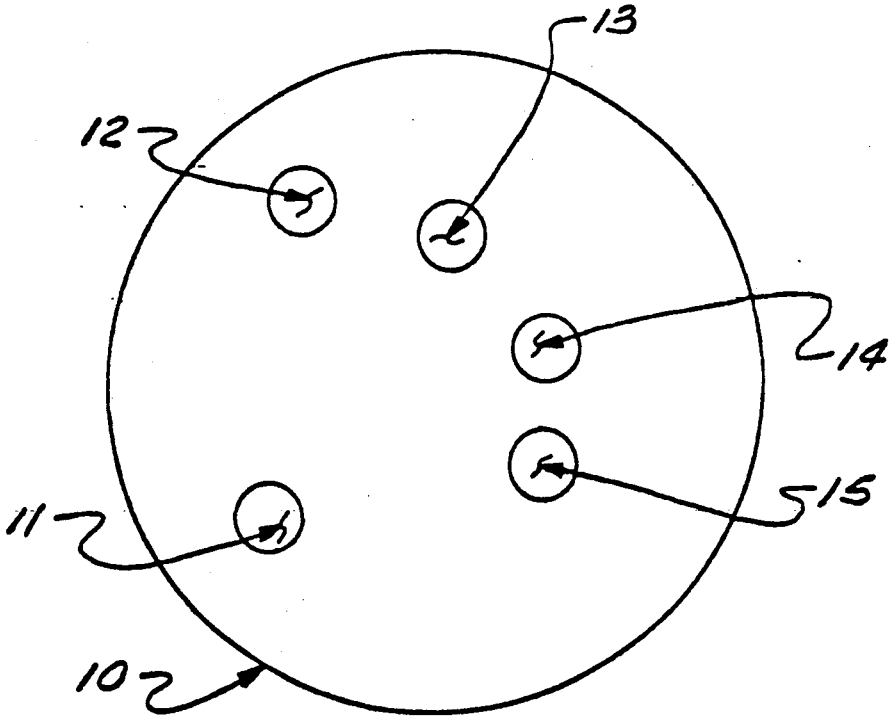
FIG. 1 is a front view of a circular or spherical embodiment of hand exerciser with finger holes.
Figure 2:
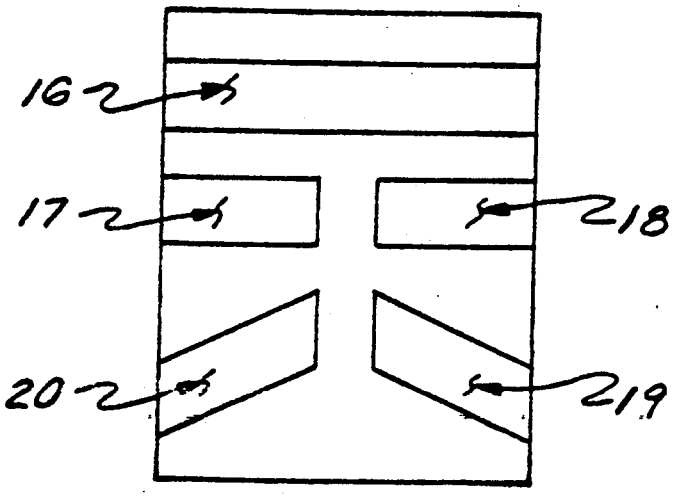
FIG. 2 is a side view in cross-section of a hand exerciser showing various types of holes that can be installed.
Figure 3:
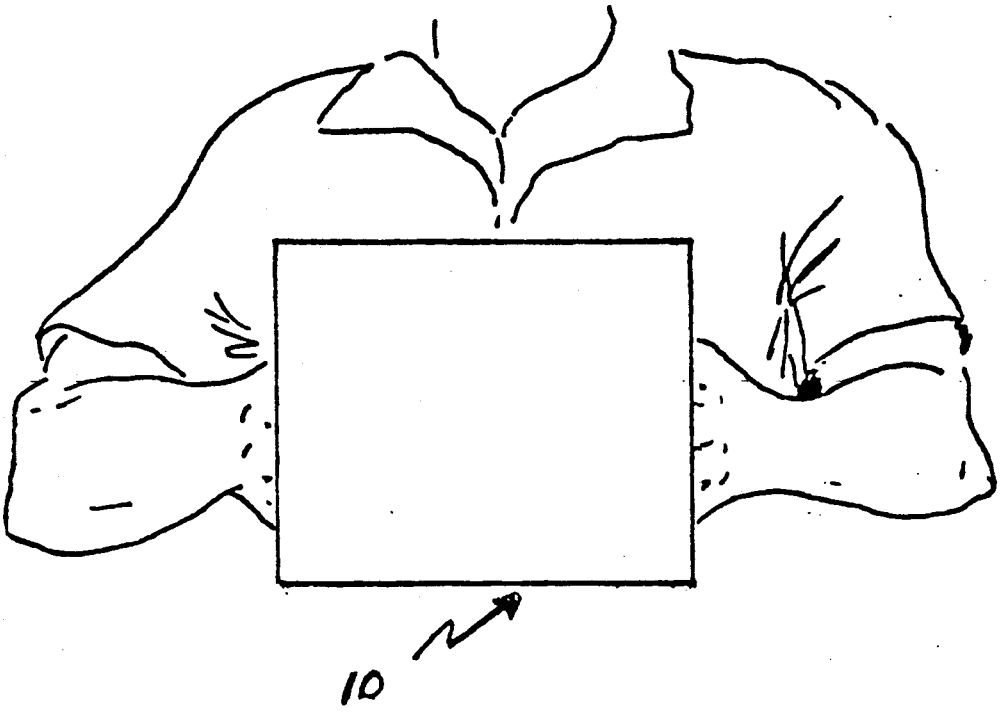
FIG. 3 is a rendition of the hand exerciser with fingers inserted when in use.

The foregoing is considered an illustration of the principles of the invention. It is not desired to limit the invention as described other than to modifications which fall within the scope of the claims, such as other compositions of polyurethane or compositions providing the same performance by other names.

I claim:

1. A therapeutic hand exerciser which comprises:

a. a body of pliable material;

b. opposing end surfaces on said body;

c. elongate finger holes extending through each opposing end surface toward the other opposing end surface;

d. said finger holes sized so as to closely encompass said fingers when inserted through said finger holes and into said body.

2. A therapeutic hand exerciser according to claim 1 in which each opposing end has four finger holes and one thumb hole.

3. A therapeutic hand exerciser according to claim 2 in which said finger and thumb holes on one end of said body join the corresponding finger and thumb holes on the other end of said body.

4. A therapeutic hand exerciser according to claim 1 in which said body is made of a polyurethane material.

5. A therapeutic hand exerciser according to claim 2 in which the centerlines of each opposing and corresponding finger and thumb holes intersect so as to form acute included angles inside said body.

6. The therapeutic hand exerciser according to claim 1 in which at least one hole extends through both ends of the body.

* * * * *